US006068140A

United States Patent [19]

Mangrum et al.

[11] Patent Number: 6,068,140

[45] Date of Patent: May 30, 2000

[54] DISPLAY UNIT

[75] Inventors: Russell E. Mangrum, Tullahoma; J. Wayne Martin, Wartrace, both of Tenn.

[73] Assignee: NK Lawn & Garden Co., Del.

[21] Appl. No.: 08/985,016

[22] Filed: Dec. 4, 1997

[51] Int. Cl.[7] ..... A47F 3/14

[52] U.S. Cl. ..... 211/132.1; 211/126.16; 211/133.1; 108/107; 108/165; 248/174

[58] Field of Search ..... 211/132.1, 73, 211/126.16, 135, 149, 128.1, 133.1; 108/107, 165; 248/174, 152

[56] References Cited

U.S. PATENT DOCUMENTS

| | | | |
|---|---|---|---|
| 689,419 | 12/1901 | Sandstrom . | |
| 781,518 | 1/1905 | Hice . | |
| 2,135,093 | 11/1938 | Abrams | 248/152 |
| 2,312,594 | 3/1943 | Smith et al. | 211/130 |
| 2,491,652 | 12/1949 | Feerick | 211/73 |
| 2,851,237 | 9/1958 | Welshenbach | 211/73 |
| 3,343,506 | 9/1967 | Buchbinder et al. | 108/107 |
| 3,892,450 | 7/1975 | Kolster et al. | 211/55 |
| 4,164,287 | 8/1979 | Muller et al. | 211/72 |
| 4,506,790 | 3/1985 | Muscari | 211/135 |
| 4,519,319 | 5/1985 | Howlett | 248/174 |
| 4,607,576 | 8/1986 | Kranjec | 108/107 |
| 4,991,804 | 2/1991 | Iannucci | 211/132.1 |
| 5,016,545 | 5/1991 | Robertson et al. | 211/135 |
| 5,050,747 | 9/1991 | Krautsack | 211/55 |
| 5,060,790 | 10/1991 | Kindelberger et al. | 211/132.1 |
| 5,213,220 | 5/1993 | McBride | 211/149 |
| 5,253,769 | 10/1993 | Vlastakis | 211/126.16 |
| 5,316,156 | 5/1994 | Land et al. | 211/149 |
| 5,485,928 | 1/1996 | Felton | 211/128.1 |
| 5,513,745 | 5/1996 | Zoltan et al. | 211/132.1 |
| 5,620,104 | 4/1997 | Maglione | 248/174 |
| 5,641,074 | 6/1997 | Smed | 211/88.01 |
| 5,706,959 | 1/1998 | Smith | 211/126.16 |

FOREIGN PATENT DOCUMENTS

| | | |
|---|---|---|
| 474400 | 4/1929 | Germany . |
| 475152 | 4/1929 | Germany . |

*Primary Examiner*—Blair M. Johnson
*Attorney, Agent, or Firm*—Luedeka, Neely & Graham, PC

[57] ABSTRACT

A display unit comprising a flame and a plurality of trays, which may be removably mounted thereon. The frame is constructed from a one-piece cardboard blank, and comprises a back panel, sides, a top and a bottom. The sides, top and bottom are foldable into a double-wall configuration for added strength and stability. The trays include anchors and anchoring tabs for securing the trays to the frame. The trays may be divided into a plurality of compartments and may include a single or multiple tiers.

4 Claims, 10 Drawing Sheets

DISPLAY UNIT

BACKGROUND OF THE INVENTION

The present invention relates generally to display units and more particularly to display units having a frame that is capable of supporting a plurality of trays or shelves when in an assembled position and that is collapsible to a flattened position for bulk shipment.

It will be appreciated by those skilled in the art that collapsible display units constructed of cardboard or other similar materials are well known. However, many of the display units known in the art are cumbersome, difficult to assemble, unstable and not aesthetically pleasing.

What is needed, then, is a display unit that is easy to assemble, is lightweight, durable and stable, and which creates an aesthetically pleasing assembly for displaying products.

SUMMARY OF THE INVENTION

The display unit of the present invention comprises a frame formed from a blank constructed of cardboard or similar material that is lightweight yet durable. Accordingly, the frame portion of the display unit may be shipped in bulk in a collapsed, flattened position. The blank is assembled to form a frame capable of supporting a plurality of trays, which are preferably constructed of plastic. However, trays constructed of other suitable materials, such as cardboard, are also contemplated to be within the scope of the present invention.

In its collapsed position, the blank comprises a back panel and flaps extending therefrom, which are foldable along fold lines defining the back panel, to form sides, a top and a bottom of the frame, respectively. When the frame is assembled, the sides, top and bottom are substantially perpendicular to the back panel. Each of the side, top and bottom flaps are further foldable along a central fold line to form inner and outer panels. The double wall configuration of the sides, top and bottom provides additional rigidity and stability to the frame. The depth of the frame, as defined by the side, top and bottom panels, is substantially equal to the depth of the tray or shelf to be mounted in the frame.

The frame includes an attachment system for retaining the top, bottom and side panels in an assembled position. The attachment system comprises a plurality of attachment tabs formed along the outer periphery of the side, top and bottom flaps, which are received within cooperatively positioned slots formed along the fold lines defining the back panel. Further, a flap extending from each end of each of the side panels is insertable between the inner and outer panels of the top and bottom of the flame in order to interlock the side panels with the top and bottom.

The display unit includes an anchoring system for securing a tray to the frame. The anchoring system comprises a plurality of slots formed along the perimeter facing of the side panels and configured to receive anchoring tabs positioned at opposing ends of the tray or shelf. Further, a plurality of slots formed in the back panel of the flame are configured to receive anchors protruding from the back of the tray or shelf in order to secure the tray to the frame.

A plurality of trays or shelves are mounted in the frame to complete the display unit. The tray preferably includes a front, a back, spaced apart sides and a bottom. The tray may be divided into a plurality of compartments, and may include a single tier or multiple tiers.

An anchoring tab is positioned adjacent the front and lower portion of each side wall of the tray. A gap of a width sufficient to receive the inner panel of the side of the frame is formed between the tab and the side wall of the tray. The anchoring tab is insertable into one of the slots formed in the outer facing of the frame to secure the tray to the frame. When the tray is installed in the frame, a barb projecting inwardly from an inner surface of the tab engages the side panel of the frame, thus anchoring the tray to the frame.

It is an object of the present invention to provide a display unit comprising a substantially rigid cardboard flame capable of supporting a plurality of removable trays or shelves.

It is another object of the present invention to provide a display unit comprising a frame that is collapsible and capable of bulk shipment in a flattened position.

It is yet another object of the present invention to provide a display unit comprising a one-piece blank that may be assembled to form a flame having a back panel, spaced apart side panels, a top panel and a bottom panel.

It is an object of the present invention to provide a display unit including a plurality of trays configured to be mounted to the frame and secured thereto by a plurality of anchors configured to cooperatively engage the back panel of the frame and by anchoring tabs adjacent the side walls of the tray which are insertable into slots formed on the facing of the frame.

These and other objects, features and advantages shall become apparent after consideration of the description and drawings set forth herein.

DESCRIPTION OF THE PREFERRED EMBODIMENT

Figure 1A:
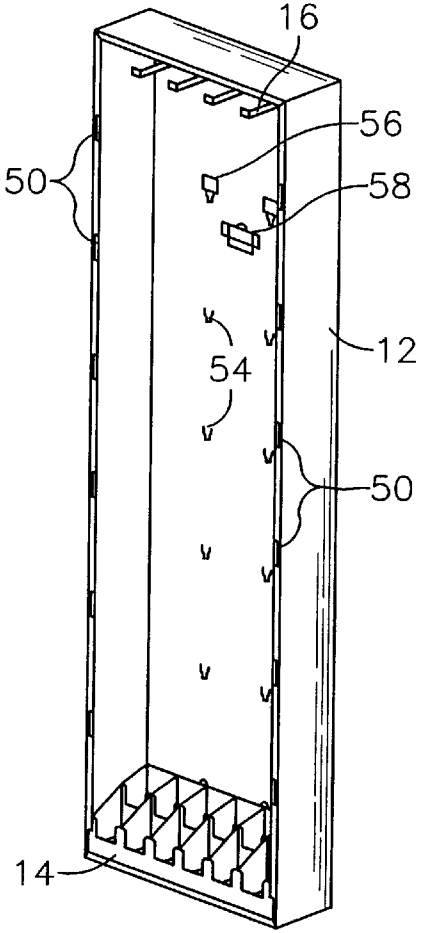
FIG. 1A is a perspective view of the display unit of the present invention showing the unit in a partially assembled position.
Figure 1B:
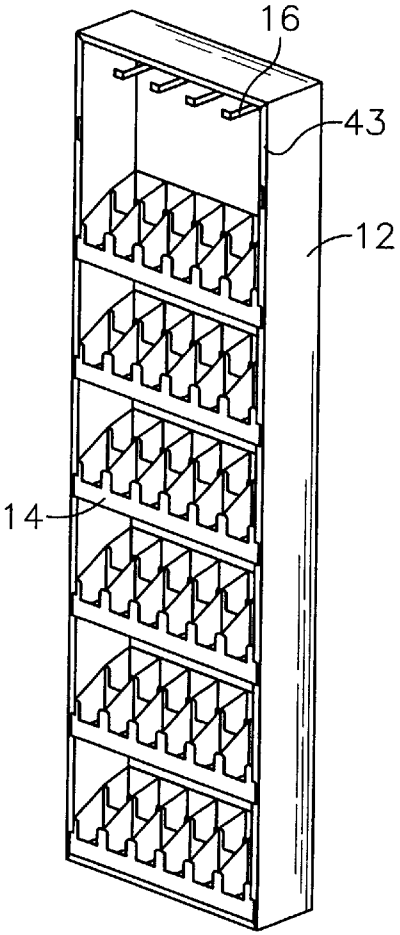
FIG. 1B is a perspective view of the display unit of the present invention showing the unit in an assembled position.
Figure 1C:
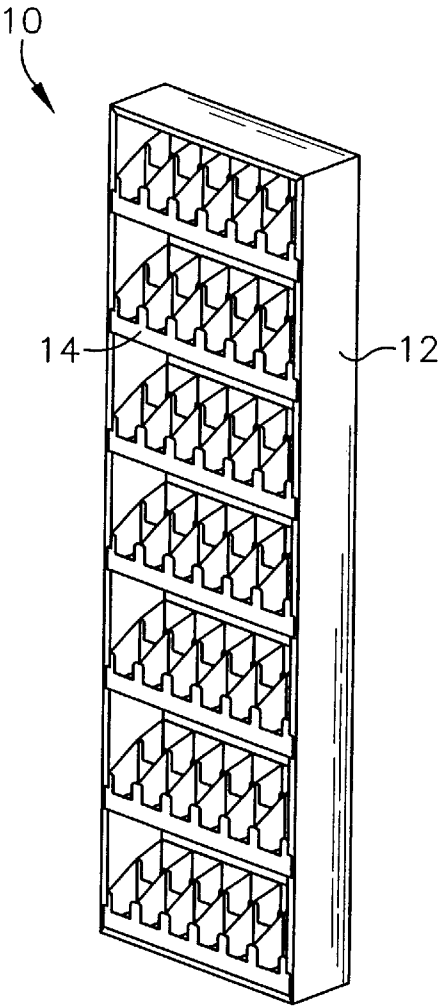
FIG. 1C is a perspective view of the display unit of the present invention showing the unit in an alternative assembled position.

With reference to FIGS. 1A, 1B and 1C, a preferred embodiment of the display unit of the present invention is designated generally by reference numeral 10. The display unit 10 comprises a frame 12 and a plurality of trays or shelves 14. The display unit 10 may further include a plurality of hooks 16 from which products may be suspended for display.

Figure 2A:
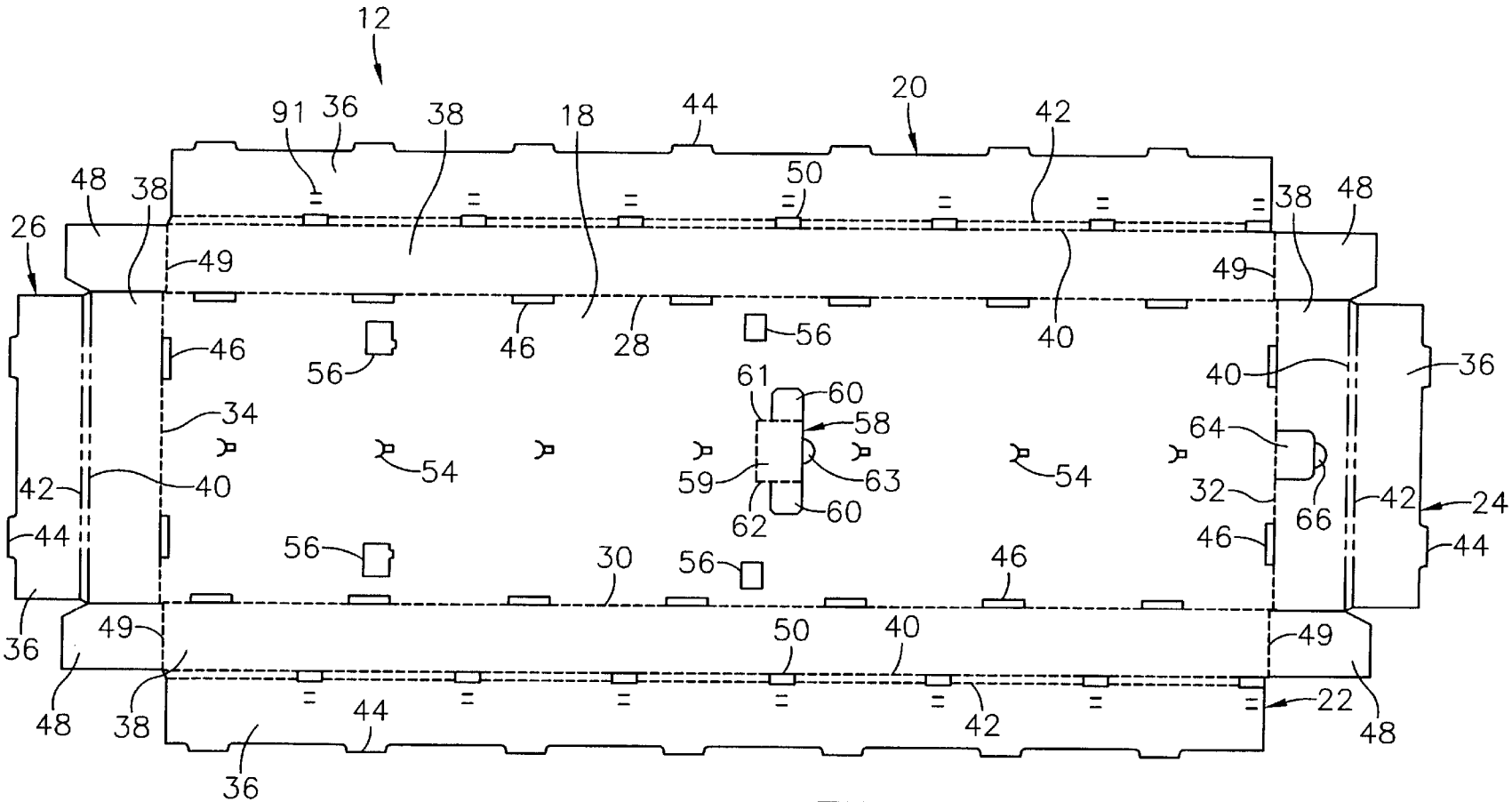
FIG. 2A is a plan view of a blank used to form the frame portion of the display unit of the present invention.
Figure 2B:
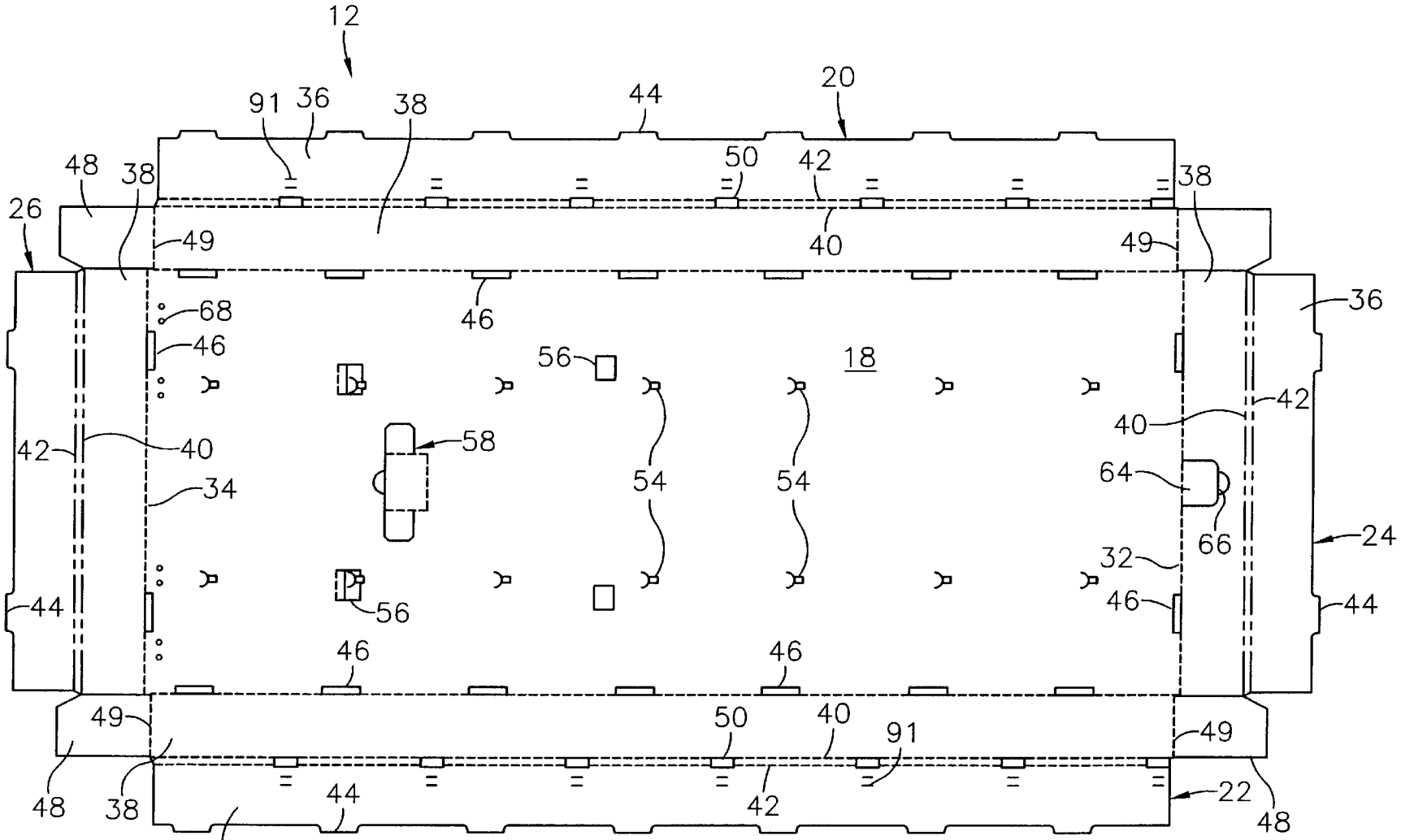
FIG. 2B is a plan view of an alternate embodiment of a blank used to form the frame portion of the display unit of the present invention.

With reference to FIGS. 2A and 2B, the frame 12 portion of the display unit 10 is preferably constructed from a cardboard blank having a back panel 18, side panels 20 and 22, a bottom panel 24 and a top panel 26, which are defined by fold lines 28, 30, 32 and 34. Each of the flaps comprising the sides 20 and 22, the bottom 24, and the top 26 are further foldable along central fold lines to form a double wall configuration comprising an inner panel 36 and an outer panel 38.

In the preferred embodiment, the central fold lines 40 and 42 of the sides 20 and 22, top 26 and bottom 24 further comprise a pair of spaced apart parallel scores 40 and 42 which extend the length of their respective panel. The spaced apart scores 40 and 42 define an edge or facing 43 about the periphery of the frame 12. The fold lines 40 and 42 along the top 26 and bottom 24 panels may include perforations for preventing the collapse of the interior corrugations of the cardboard material when the top 26 and bottom 24 panels are folded along their respective central fold lines 40 and 42.

A plurality of attachment tabs 44 are formed at spaced intervals along the outer periphery of the side panels 20 and 22, the bottom panel 24 and the top panel 26. When the flame 12 is assembled, the tabs 44 are received within cooperatively positioned slots 46 formed along the fold lines 28, 30, 32 and 34 defining the back panel 18 to retain the side 20 and 22, the top 26 and the bottom 24 panels in position.

A flap 48 extending from each end of each of the side panels 20 and 22, and defined by fold line 49, is insertable between the inner 36 and outer 38 panels of the top 26 and bottom 24 of the flame 10 in order to interlock the side panels 20 and 22 with the top 26 and bottom 24 of the frame 10.

A plurality of slots 46 formed along the outer facing 43 of the side panels 20 and 22 are configured to receive anchoring tabs 88 extending from opposing ends 74 and 76 of a tray or shelf 14 (discussed hereinbelow). Further, a plurality of slots or apertures 54 formed in the back panel 18 of the frame 10 are configured to receive anchors 92 protruding from the back 72 of the tray or shelf 14 in order to secure the tray 14 to the frame 10. The slots 54 may be positioned in a single central column extending the length of the back panel 18, or in multiple columns, depending on the particular embodiment of the display unit 10 (see FIGS. 2A and 2B).

In the preferred embodiment, a plurality of spaced apart apertures 56 are formed in the back panel 18 to facilitate mounting of the display unit 10 on a support rack (not shown). The apertures 56 are configured to engage cooperatively positioned hooks on the support rack. Further, the frame 12 may also include a hinged butterfly 58 formed in the back panel 18 and a hinged tongue 64 formed in the outer panel 38 of the bottom 24 for enabling the display unit 10 to be mounted on a pedestal or base support (not shown). The butterfly 58 is preferably hinged to the back panel 18 across a bottom of the body 59, and includes wings 60 extending from sides of the body 59 and defined by fold lines 61 and 62. A finger hole 63 may be formed in the back panel 18 along a top of the body 59 to facilitate disengagement of the butterfly 58 with the back panel 18. Similarly, a finger hole 66 may be formed adjacent the tongue 64 to facilitate disengagement of the tongue 64 and the bottom panel 24.

With reference to FIG. 2B, the back panel 18 may also include a plurality of spaced apart holes 68 configured to receive hooks 16 to which merchandise may be attached for display.

Figure 3:
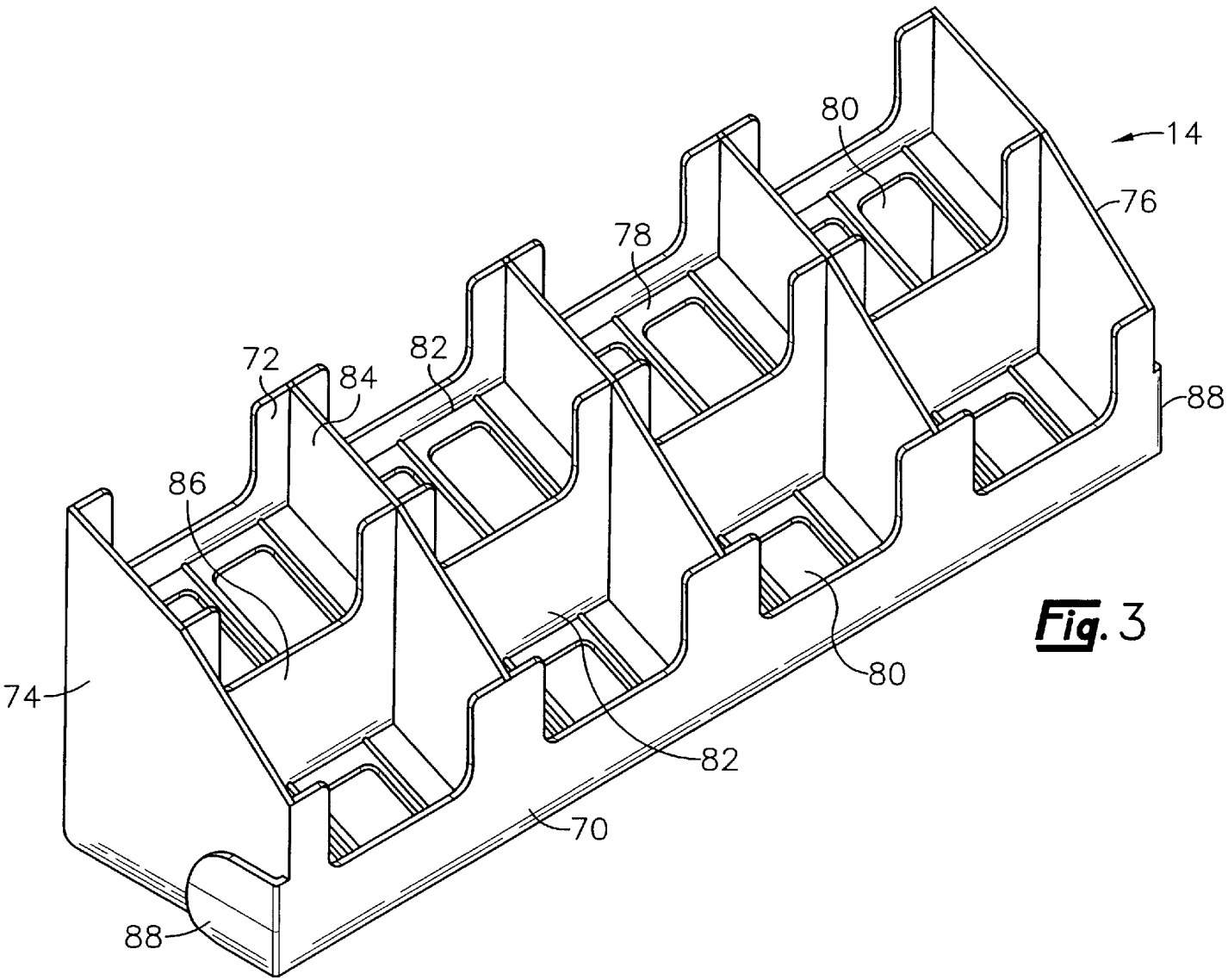
FIG. 3 is a perspective view of an embodiment of the tray of the present invention.

With reference to FIGS. 1C and 3, a plurality of trays or shelves 14 are mounted to the frame 10 to display merchandise. In the preferred embodiment, the tray 14 comprises a front 70, a back 72, spaced apart sides or ends 74 and 76, and a bottom 78. The bottom 78 may include a plurality of openings 80 to facilitate cleaning and maintenance of the tray 14 (see FIGS. 6A and 6B). The tray 14 may be divided into a plurality of compartments 82 separated by divider walls 84 extending between the front 70 and the back 72 walls. Further, the tray 14 may include multiple tiers formed by divider walls 86 extending between the side or end walls 74 and 76 (see FIG. 7).

While a preferred embodiment of the tray 14 is shown, alternative configurations of trays or shelves are contemplated to be within the scope of the present invention. The desired configuration of the tray or shelf will vary according to the type of goods being displayed thereon. Thus, a substantially planar shelf may be desirable for certain products, whereas a compartmentalized tray may be more appropriate for others.

Figure 4:
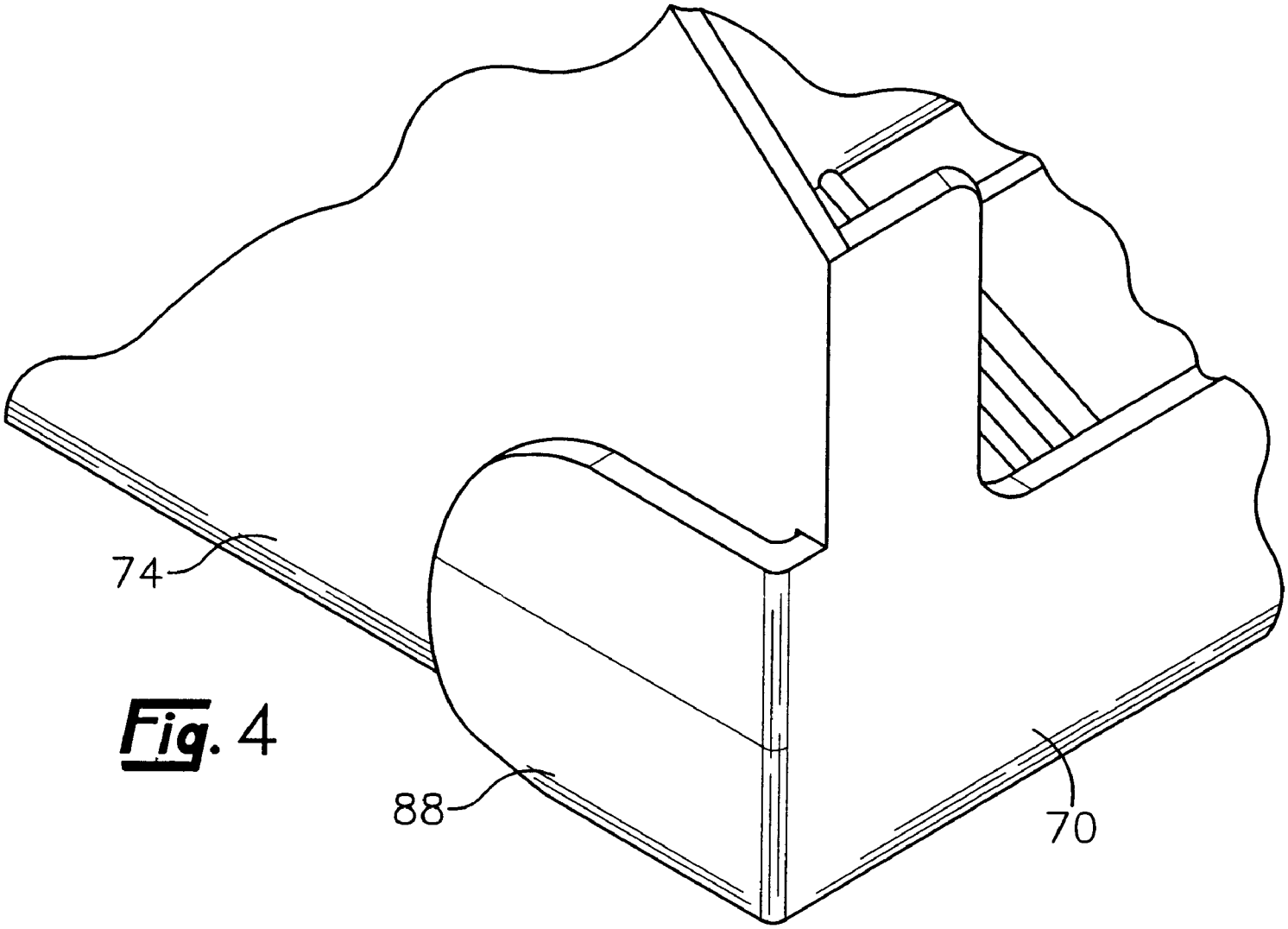
FIG. 4 is a partial perspective view of the tray of the present invention showing the anchoring tab for securing the tray to the frame portion of the display unit.

With reference to FIG. 4, an anchoring tab 88 is positioned adjacent each end 74 and 76 of the tray 14. In the preferred embodiment, the anchoring tabs 88 extend from and are formed integrally with the front wall 70 of the tray or shelf 14. Each tab 88 extends perpendicularly from an end of the front 70 of the tray 14 and is, therefore, positioned in overlapping relationship with the end wall 74 or 76. The tabs 88 extend from the front wall 70 a distance that is slightly beyond the point of intersection of the front 70 and end walls 74 and 76 before turning perpendicularly inward adjacent the end walls 74 and 76. Accordingly, a gap 89 is formed between the tab 88 and the end wall 74 or 76 of the tray 14.

The anchoring tabs 88 are insertable into one of the slots 50 formed along the outer facing 43 of the frame 12 to secure the tray 14 to the frame 10. A barb 90 projects inwardly from an inner surface of the anchoring tab 88 into the gap 89. Thus, when a tray 14 is installed in the flame 10, the barb 90 engages the inner panel 36 of the of the sides 20 and 22 frame 10 to anchor the tray 14 to the frame 10. The inner panels 36 of the sides 20 and 22 may include a plurality of spaced apart slits 91 on which a tip of the barb 90 may "catch" to prevent the inadvertent disengagement of the tray 14 from the frame 10.

Figure 6A:
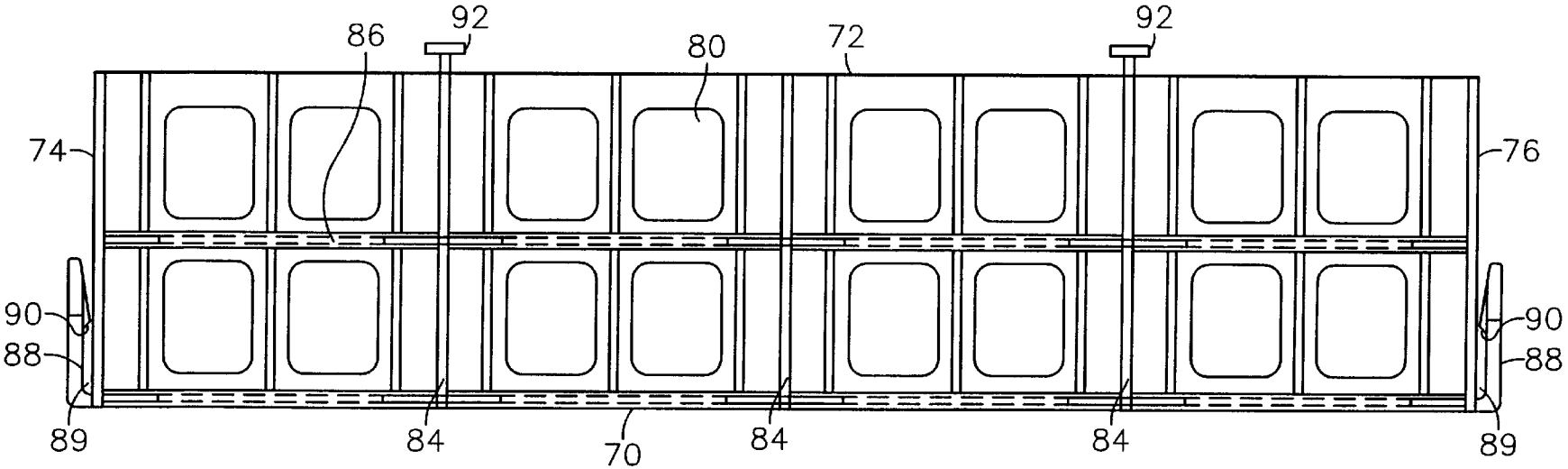
FIG. 6A is a top view of the embodiment of the tray shown in FIG. 3.
Figure 6B:
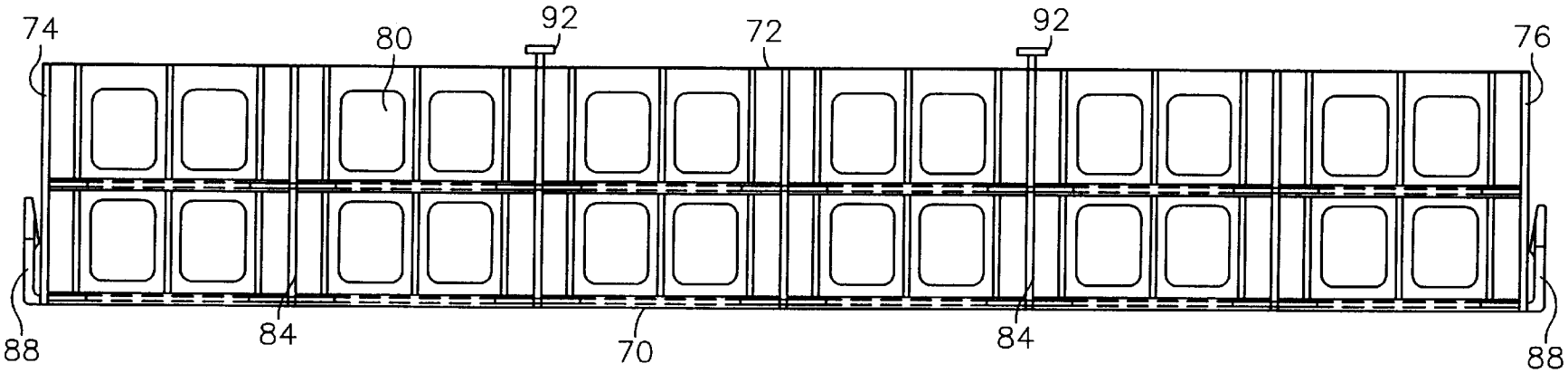
FIG. 6B is a top view of an alternate embodiment of the tray of the present invention.
Figure 7:
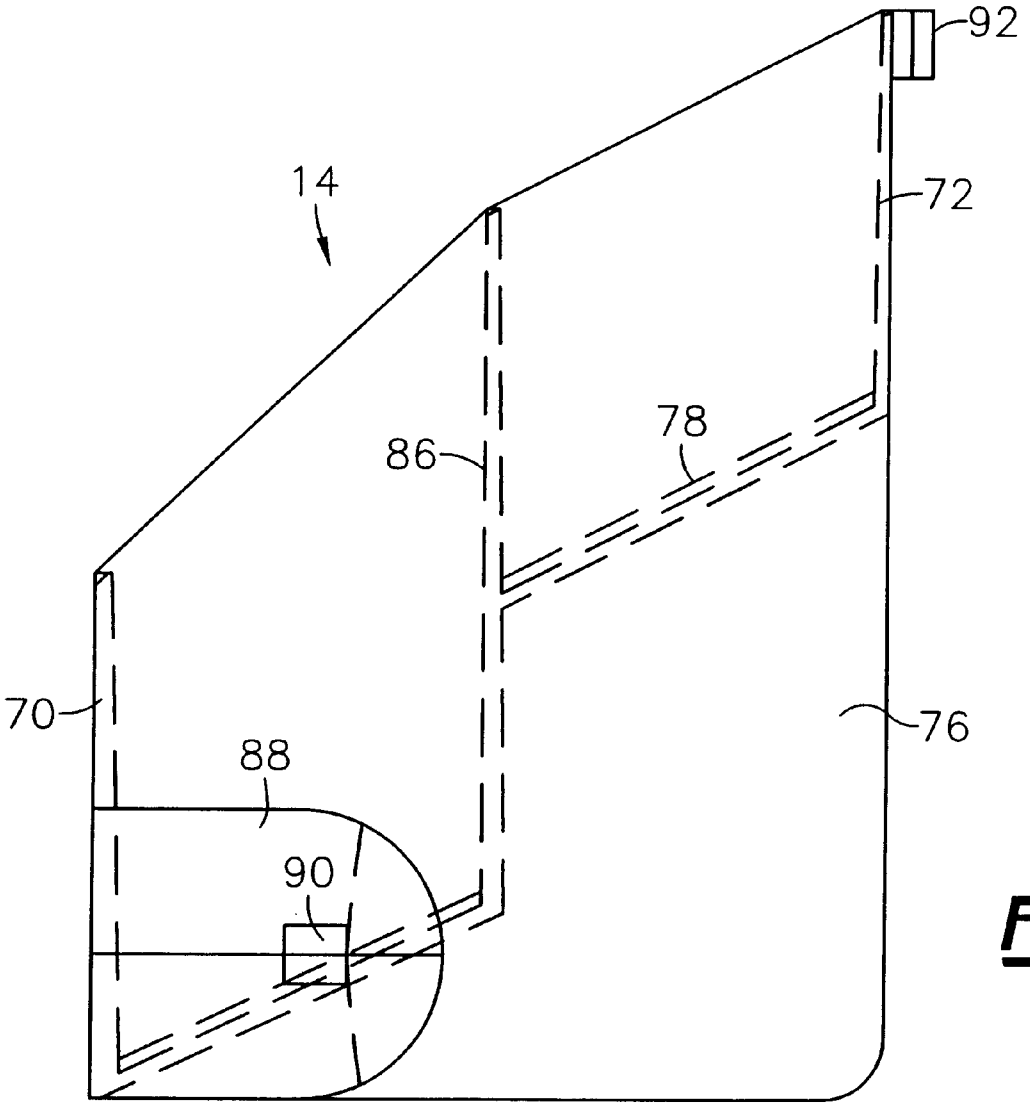
FIG. 7 is a side view of the tray of the present invention.

With reference to FIGS. 6A, 6B and 7, at least one anchor 92 projects from the back 72 of the tray 14. The anchor 92 is configured to be received within any of the slots 54 formed in the back panel 18 to further anchor the tray 14 to the frame 12.

Figure 5A:
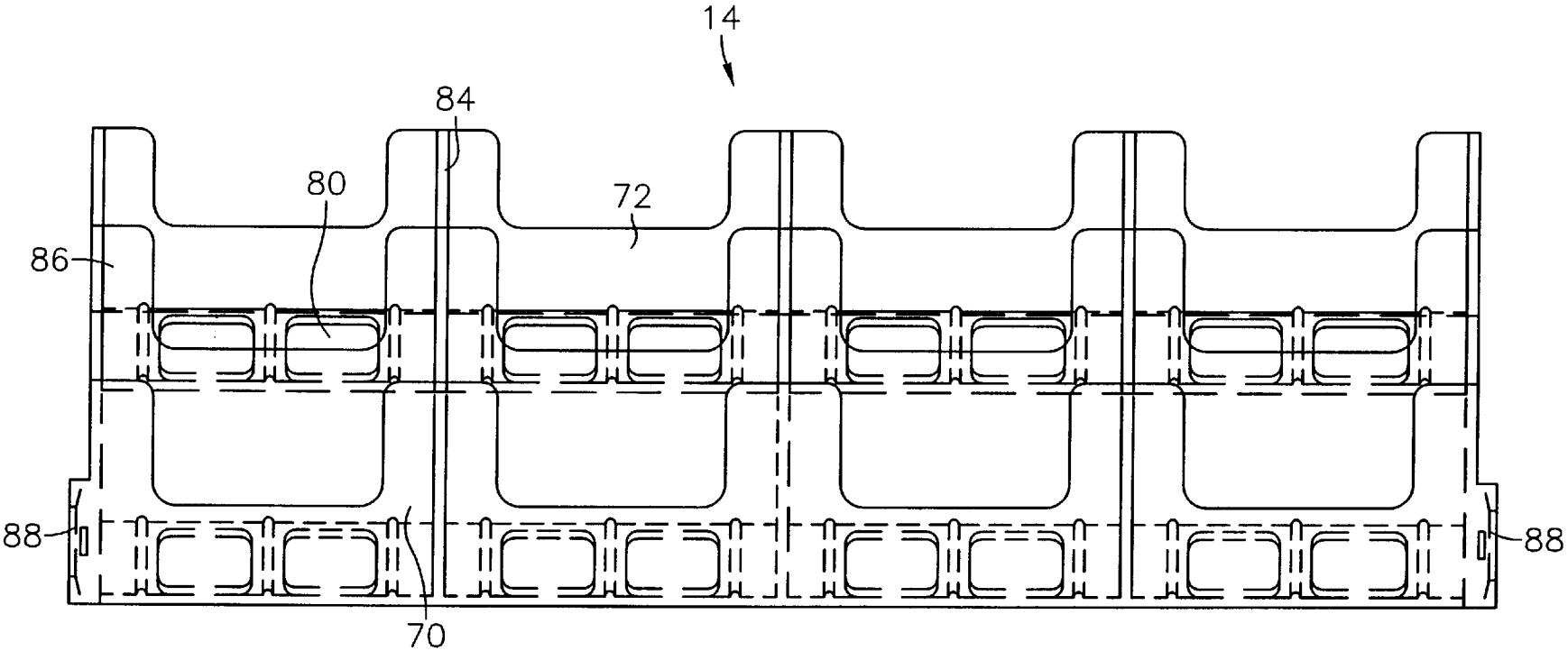
FIG. 5A is a front view of the embodiment of the tray shown in FIG. 3.
Figure 5B:
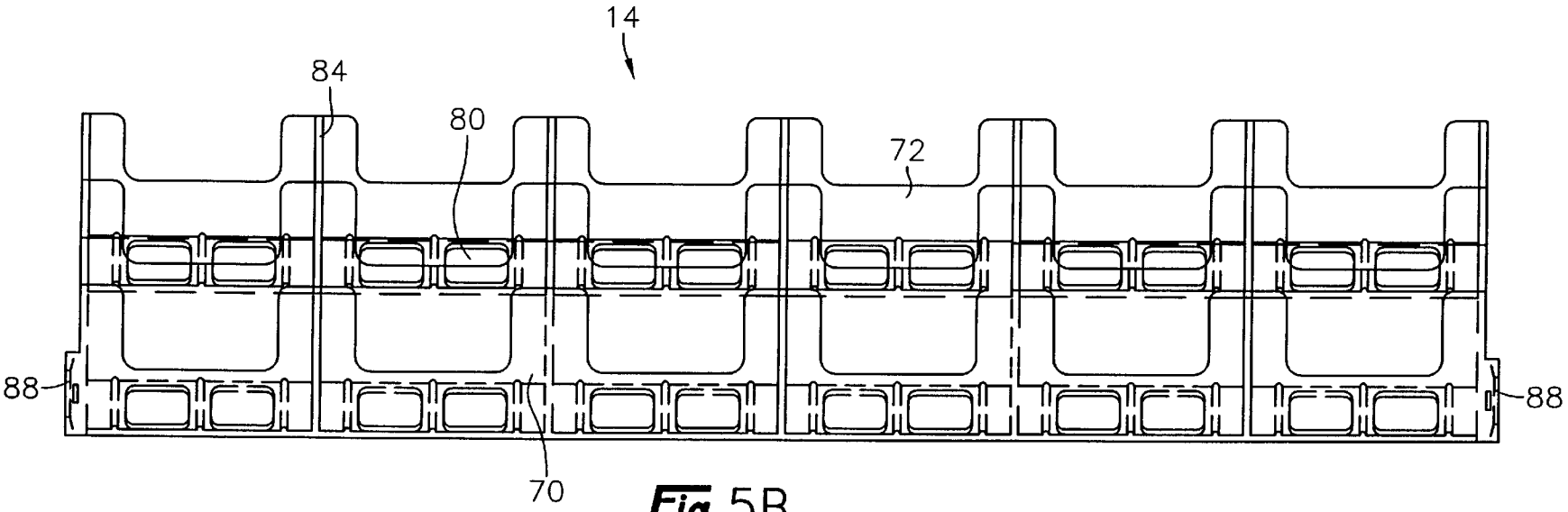
FIG. 5B is a front view of an alternate embodiment of the tray of the present invention.

FIGS. 5A and 6A show a four-cell, two-tier tray 14, which is intended to be used in conjunction with the flame embodiment 10 shown in FIG. 2A. Alternatively, FIGS. 5B and 6B show a six-cell, two-tier tray 14, which is intended to be used in conjunction with the flame embodiment 10 shown in FIG. 2B. However, as indicated hereinabove, other tray or shelf configurations incorporating the anchoring features described herein are also contemplated to be within the scope of the present invention.

To assemble the display unit 10 from the blank of FIGS. 2A and 2B, flaps 48 are folded inward along fold lines 49 toward their respective side panels 20 and 22. Side panels 20 and 22 are then folded perpendicularly along fold lines 28 and 30, respectively. Top panel 26 and bottom panel 24 are similarly folded along fold lines 32 and 34, respectively. Flaps 48 are positioned adjacent the inner panels 36 of the top panel 26 and the bottom panel 24. The outer panels 38 of the top panel 26 and the bottom panel 24 are then folded over along fold lines 40 and 42 to form a double wall configuration. Locking tabs 44 are inserted into mating slots 46 to retain the top panel 26 and the bottom panel 24 in place.

The side panels 20 and 22 are similarly assembled. Thus, the outer panels 38 of side panels 20 and 22 are folded over along fold lines 40 and 42 to form a double wall configuration. Locking tabs 44 are inserted into mating slots 46 to retain the side panels 20 and 22 in place.

Once the flame 12 is fully assembled, trays 14 may be installed thereon. In order to install a tray 14, anchors 92 are inserted into slots 54 formed in the back panel 18 of the frame 12. Anchoring tabs 88 are inserted into slots 50 on the outer facing 43 of the frame 12. The tray 14 is secured in the frame 12 by seating the anchors 92 in slots 54 and by seating the anchoring tabs 88 in slots 50. When the anchoring tabs 88 are fully seated, the barbs 90 will engage the inner panels 36 of side panels 20 and 22.

The user may install as many trays 14 as necessary to achieve the desired configuration. Moreover, hooks 16 may also be installed in holes 68 for displaying merchandise.

Thus, although there have been described particular embodiments of the present invention of a new and useful display unit, it is not intended that such references be construed as limitations upon the scope of this invention except as set forth in the following claims. Further, any dimensions used in the preferred embodiment are not intended to be construed as limitations upon the scope of this invention except as set forth in the following claims.

What is claimed is:

1. A display unit, comprising:

a frame having a back, a top, a bottom and spaced apart sides;

at least one tray mounted to the frame;

wherein the frame is formed from a foldable blank, further including, a plurality of fold lines defining the back, top, bottom and sides, a plurality of tabs formed along an outer periphery of the top, bottom and sides, a plurality of slots formed along the fold lines defining the back, top, bottom and sides and cooperatively positioned to receive the tabs each slot being configured to receive one of the tabs;

wherein the top, bottom and sides each comprise an inner panel and an outer panel to form a double wall configuration;

a plurality of slots formed along central fold lines of each of the side panels;

a plurality of spaced apart slots formed in the back panel; and wherein the at least one tray further includes, a back, a front, a bottom and spaced apart ends, at least one anchor protruding from the back of the at least one tray and positioned to cooperatively engage any one of the plurality of slots formed on the back of the frame, an anchoring tab adjacent each end of the tray and configured to cooperatively engage any one of the plurality of slots formed along the central fold lines of the sides of the frame.

2. A collapsible display unit, comprising:

a frame constructed from a blank having a plurality of fold lines defining a back panel and having a plurality of flaps extending therefrom which are foldable along the fold lines to form a top, a bottom and spaced apart sides of the frame;

at least one tray mounted to the frame;

wherein each of the top, bottom and sides are foldable along a central fold line to form an inner panel in opposed relation to an outer panel, each opposed inner and outer panel having substantially the same length;

wherein the display unit further includes an anchoring system for anchoring the tray thereto, said anchoring system including:

a anchoring tab positioned adjacent spaced apart ends of the at least one tray and configured to cooperatively engage any of a plurality of openings formed along the central fold lines of each of the sides;

a barb projecting inwardly along an inner surface of the anchoring tab;

at least one anchor protruding from a back of the tray and configured to cooperatively engage any of a plurality of openings formed in the back panel; and at least one opening formed on the inner panels of the sides of the frame for cooperatively engaging the barb to prevent disengagement of the at least one tray from the frame.

3. A collapsible display unit comprising:

a frame constructed from a blank having a plurality of fold lines defining a back panel and having a plurality of flaps extending therefrom which are foldable along the fold lines to form a top, a bottom and spaced apart sides of the frame, said spaced apart sides of the frame being foldable along a central fold line to form an inner panel in opposed relation to an outer panel, each of the central fold lines including one or more openings;

at least one tray configured to be mounted to the frame, said at least one, tray including a plurality of tiers; and an anchoring system for anchoring the at least one tray to the frame, said anchoring system including:

an anchoring tab adjacent each end of the tray and configured to cooperatively engage any of the plurality of openings formed along the central fold lines of the sides of the frame; and a barb projecting inwardly along an inner surface of the tab for engaging the inner side panel when the tray is installed in the frame.

4. A collapsible display unit comprising:

a frame constructed from a blank having a plurality of fold lines defining a back panel and having a plurality of flaps extending therefrom which are foldable along the fold lines to form a top, a bottom and spaced apart sides of the frame, said spaced apart sides of the frame being foldable along a central fold line to form an inner panel in opposed relation to an outer panel, each of the central fold lines including one or more openings;

at least one tray configured to be mounted to the frame, said at least one tray including a plurality of tiers having a plurality of tray compartments; and an anchoring system for anchoring the at least one tray to the frame, said anchoring system including:

an anchoring tab adjacent each end of the tray and configured to cooperatively engage any of the plurality of openings formed along the central fold lines of the sides of the frame; and a barb projecting inwardly along an inner surface of the tab for engaging the inner side panel when the tray is installed in the frame.

* * * * *